US006332397B1

(12) United States Patent
Bolza-Schünemann et al.

(10) Patent No.: US 6,332,397 B1
(45) Date of Patent: Dec. 25, 2001

(54) PRINT UNIT

(75) Inventors: Claus August Bolza-Schünemann, Würzburg; Christian Martin Michael Fischer, Martheidenfeld; Michael Heinz Fischer, Würzburg; Kurt Johannes Weschenfelder, Zell, all of (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/463,392

(22) PCT Filed: Jul. 23, 1998

(86) PCT No.: PCT/DE98/02065

§ 371 Date: Jan. 28, 2000

§ 102(e) Date: Jan. 28, 2000

(87) PCT Pub. No.: WO99/06211

PCT Pub. Date: Feb. 11, 1999

(30) Foreign Application Priority Data

Jul. 28, 1997 (DE) ..... 197 32 330

(51) Int. Cl.[7] ..... B41F 9/00

(52) U.S. Cl. ..... 101/183; 101/216; 101/217; 101/220; 101/221

(58) Field of Search ..... 101/216, 219, 101/220, 221, 181, 183

(56) References Cited

U.S. PATENT DOCUMENTS

| | | | | |
|---|---|---|---|---|
| 3,606,800 | | 9/1971 | Treff et al. . | |
| 4,207,815 | * | 6/1980 | Watanabe | 101/248 |
| 4,218,972 | * | 8/1980 | Fujidhiro | 101/177 |
| 5,429,051 | * | 7/1995 | Laubscher | 101/417 |
| 5,535,677 | * | 7/1996 | Fannin et al. | 101/486 |
| 5,619,921 | * | 4/1997 | Iijima et al. | 101/181 |
| 5,706,725 | * | 1/1998 | Kolbe et al. | 101/216 |
| 5,778,779 | * | 7/1998 | Jones et al. | 101/216 |
| 5,782,182 | | 7/1998 | Ruckmann et al. . | |
| 5,826,505 | | 10/1998 | Volz et al. . | |
| 5,950,538 | * | 9/1999 | Puschnerat | 101/217 |
| 5,953,991 | * | 9/1999 | Geissenberger et al. | 101/218 |
| 5,979,317 | * | 11/1999 | Singler | 101/218 |
| 6,050,185 | | 4/2000 | Richards . | |
| 6,138,566 | * | 10/2000 | Sakamoto | 101/463.1 |

FOREIGN PATENT DOCUMENTS

| | | |
|---|---|---|
| 4408025 A1 | 9/1995 | (DE) . |
| 4430693 A1 | 3/1996 | (DE) . |
| 0644048 A2 | 12/1994 | (EP) . |
| 0812683 A1 | 4/1997 | (EP) . |
| 46-5908 | 12/1971 | (JP) . |
| 8-85196 | 4/1996 | (JP) . |

* cited by examiner

*Primary Examiner*—Ren Yan
*Assistant Examiner*—Ken D. Williams
(74) *Attorney, Agent, or Firm*—Jones Tullar & Cooper, PC

(57) ABSTRACT

A print unit of an offset printing machine utilizes individually driven cylinders. Each forme cylinder or plate cylinder is driven by its own, separate drive motor. The blanket cylinders, or cooperating blanket cylinders and counter-pressure cylinders are driven together by associated drive motors.

11 Claims, 4 Drawing Sheets

PRINT UNIT

FIELD OF THE INVENTION

The present invention relates to a print unit of an offset printing press. The forme cylinder is driven by a motor while the transfer cylinder is driven by a separate motor.

DESCRIPTION OF THE PRIOR ART

A rotary offset printing press with rubber blanket and plate cylinders is known from EP 0 644 048 A2. For their common drive, these rubber blanket and plate cylinders are combined in pairs into cylinder groups by a mechanical coupling. Each such cylinder group is respectively driven by its own drive motor.

DE 44 30 693 A1 discloses print units of a rotary offset printing press, wherein at least one cylinder is individually driven, and in which associated plate and rubber blanket cylinders are combined into groups for being driven.

Later published EP 0 812 683 A1 describes a web-fed rotary printing press, wherein each print unit has a forme, a rubber blanket and a printing cylinder. The forme cylinder of each print unit has its own drive motor.

SUMMARY OF THE INVENTION

The object of the present invention is based on providing a print unit.

In accordance with the present invention, this object is attained by the provision of a print unit of an offset printing press with a forme cylinder having its own drive motor, and of a transfer cylinder with its own motor. If there are two forme cylinders, each has its own drive motor. The two transfer cylinders can be coupled and driven by their own drive motor. Alternatively, the transfer cylinder and its associated counter-pressure cylinder can be driven by a common drive motor.

Mechanical devices for adjusting the circumferential registration are omitted in an advantageous manner in the print unit of the present invention. If an adjustment of the circumferential registration is performed with the aid of the separate drive of the plate cylinders by changing a phase position of the plate cylinders in respect to each other, a relative angle of rotation position of the rubber blanket cylinders in respect to each other remains unchanged. Channels of the rubber blanket cylinders remain in an unchanged position in relation to each other. The position of a channel of a plate cylinder does change in relation to the channel of the associated rubber blanket cylinder, but since the channel, which forms a non-printing area of the plate cylinder is customarily smaller than the channel of the associated rubber blanket cylinder, the channel of the plate cylinder does not exceed the area of the channel of the rubber blanket cylinder.

Therefore, the printing area, as a result of the channels of the rubber blanket cylinders, is not reduced, even when the circumferential registration is changed.

In comparison with prior print units, each of whose cylinders has its own individual drive, the outlay for the electrical equipment is considerably less in the print unit of the present invention.

It is possible, in particular for the flying change of printing plates ("imprinter"), to selectively stop each plate cylinder of a print unit, while the web is guided by the associated rubber blanket, or respectively by the counter-pressure, cylinders.

BRIEF DESCRIPTION OF THE DRAWINGS

Preferred embodiments of the present invention are represented in the drawings and will be described in greater detail in what follows. Shown are in.

DESCRIPTION OF THE PREFERRED EMBODIMENTS

Figure 1:
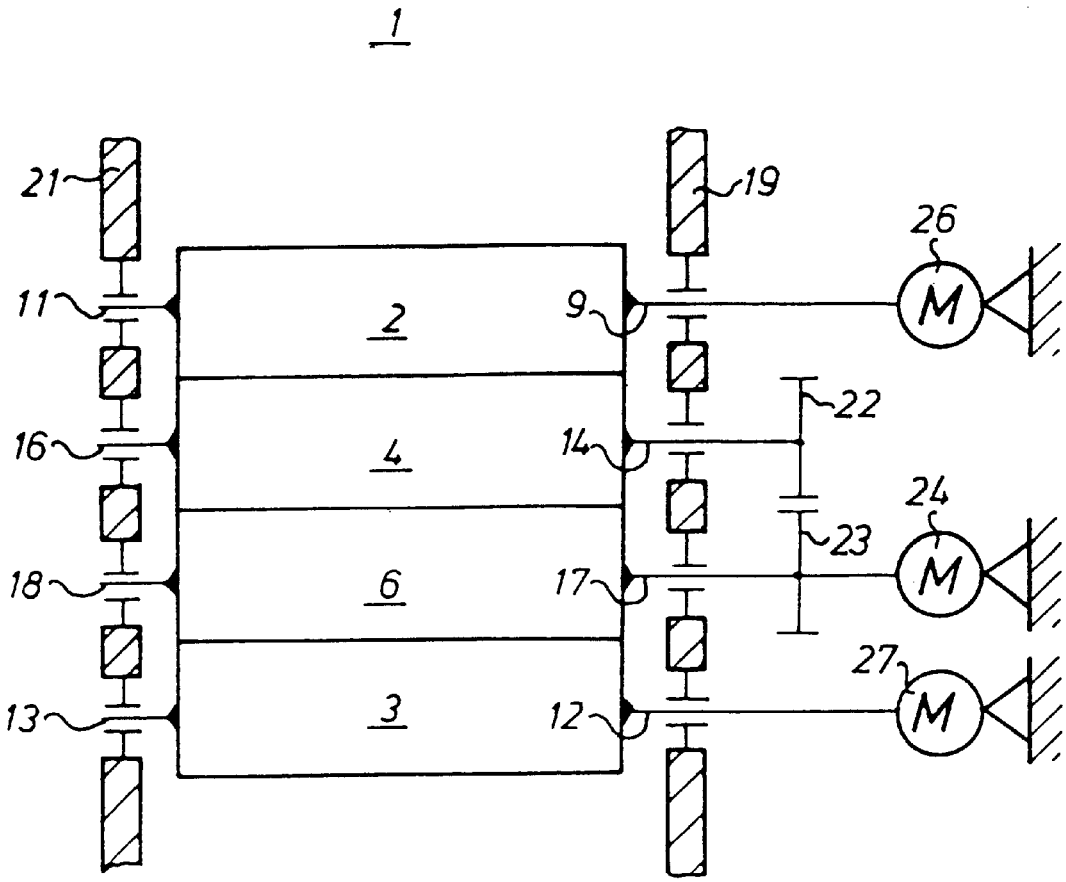
FIG. 1, a schematic representation of a top plan view on a print unit of a first preferred embodiment of the present invention, FIG. 2, the schematic representation of a side elevation view of the print unit of the first preferred embodiment, FIG. 3, the schematic representation of a side elevation view of a print unit of a second preferred embodiment, FIG. 4, the schematic representation of a side elevation view of a print unit of a third preferred embodiment, FIG. 5, the schematic representation of a side elevation view of a print unit of a fourth preferred embodiment, FIG. 6, the schematic representation of a side elevation view of a print unit of a fifth preferred embodiment, and FIG. 7, a schematic representation of a top plan view on a print unit of a sixth preferred embodiment.
Figure 2:
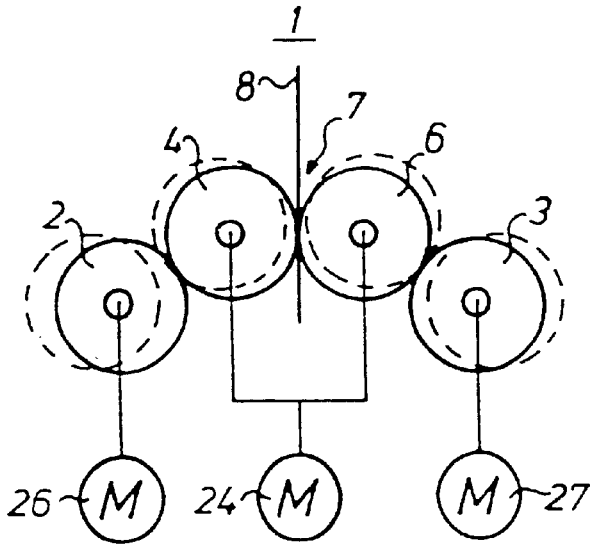
Figure 3:
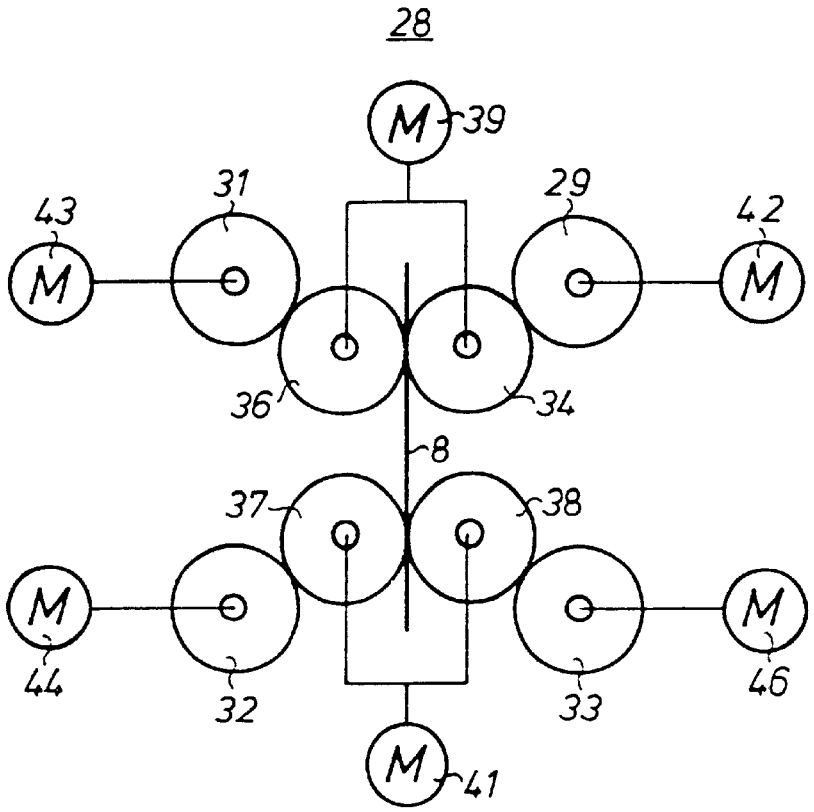

In the present first preferred embodiment as shown in FIGS. 1 and 2, a print unit 1 of an offset rotary printing press in so-called bridge construction is represented. Essentially, this print unit 1 is constituted by two forme cylinders 2, 3 and two transfer cylinders 4, 6, for example plate cylinders 2, 3 and rubber blanket cylinders 4, 6, which act together in pairs. In their contact zone, the two rubber blanket cylinders 4, 6 form a print location 7, in which a web of material 8, for example a paper web 8, is being printed. These plate and rubber blanket cylinders 2, 3, 4, 6 are each provided, on both ends, with journals 9, 11 to 14, 16 to 18, which are seated in lateral frames 19, 21 of the offset rotary printing press. In a known manner, the plate and rubber blanket cylinders 2, 3, 4, 6 are arranged to be placed against each other or removed from each other, for example by means of eccentric bushings. For example, each rubber blanket cylinder 4 or 6 can be arranged to be placed against or removed from the associated plate cylinder 2 or 3, respectively. The journals 9, 12, 14, 17 of the plate and rubber blanket cylinders 2, 3, 4, 6 extend on one side through the lateral frame 19. The journals 14, 17 of the two rubber blanket cylinders 4, 6 are provided with cooperating gear wheels 22, 23. These two rubber blanket cylinders 4, 6 are driven by a common driving mechanism 24, for example a positionally adjustable electric motor 24. For example, the rotor of this electric motor 24 may be arranged directly, i.e. without gearing, on a rubber blanket cylinder 6. The drive mechanism 24 can also be provided on any arbitrary one of the rubber blanket cylinders 4, 6 directly or indirectly, for example by means of a gear such as a gear wheel or a belt.

Each of the two plate cylinders 2, 3 is provided with its own drive mechanism 26, 27 each of which, for example, is designed as a positionally adjustable electric motor 26, 27. Here, too, the drive of the respective plate cylinders 2, 3 can take place directly or through a gear.

The drive mechanism 24 for the rubber blanket cylinders 4, 6 and the drive mechanisms 26, 27 for the two plate cylinders 2, 3 are synchronized with each other.

It is possible to place a third pair of plate and rubber blanket cylinders against one of the two rubber blanket cylinders 4, 6. In this case, the third rubber blanket cylinder forms a second print location with the second or first rubber blanket cylinder. The third rubber blanket cylinder is then provided with a gear wheel which, for example, meshes with the gear wheel of the cooperating rubber blanket cylinder. The third rubber blanket cylinder is mechanically, for example interlockingly, coupled to the first or to the second rubber blanket cylinder.

The third plate cylinder is also provided with its own, positionally adjustable electric motor and is therefore individually driven.

A print unit 28 in a so-called H-construction is represented in the second preferred embodiment. Four plate cylinders 29, 31, 32 and 33, and four rubber blanket cylinders 34, 36, 37 and 38 are provided in this second print unit 28, of which respectively two of the rubber blanket cylinders 34, 36, or respectively 37, 38, are arranged placed against each other and print the web 8. These two cooperating rubber blanket cylinder pairs 34, 36, or respectively 37, 38 are each connected and are each driven by a separate drive motor 39, 41. However, it is also possible to couple all four rubber blanket cylinders 34, 36, 37, 38 and to drive these four coupled rubber blanket cylinders 34, 36, 37, 38 by means of a common drive motor.

In this case, every plate cylinder 29, 31, 32, 33 has its own drive motor 42, 43, 44, 46, which is independent of the rubber blanket cylinders 34, 36 , 37, 38.

Figure 4:
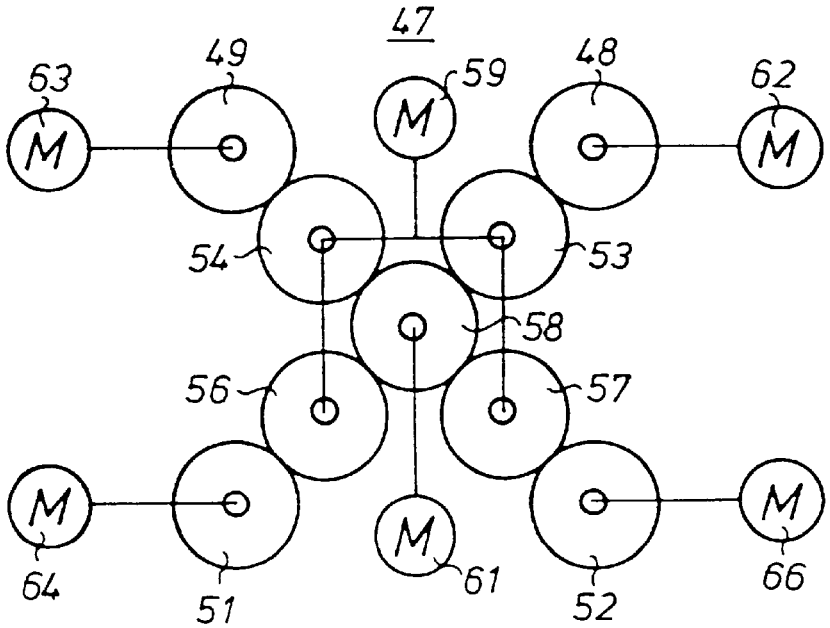

A print unit 47, which is designed as a so-called nine satellite unit is depicted in a third preferred embodiment which is shown in FIG. 4.

In this type of a print unit 47, four plate and rubber blanket cylinders 48, 53; 49, 54; 51, 56; 52, 57 are arranged in pairs and work together with a satellite cylinder 58 that is acting as a counter-pressure cylinder 58. In this case, at least two rubber blanket cylinders, but preferably all rubber blanket cylinders 53, 54, 56, 57, are coupled with each other and are all driven by a common drive motor 59. However, it is also possible to combine the rubber blanket cylinders into arbitrary groups, and to drive a respective group by its own drive motor. For example, two groups each of respectively two rubber blanket cylinders 53, 54; 56, 57 can each have a drive motor.

In the present example, the satellite cylinder 58 has its own drive motor 61, but it is also possible to couple the satellite cylinder 58 with a group of the rubber blanket cylinders. With a nine satellite print unit, all of the rubber blanket cylinders 53, 54, 56, 57 and the satellite cylinder 58 are preferably coupled with each other and are driven by a common drive motor. In this case, the drive motor first acts on the satellite cylinder 58, and through which the rubber blanket cylinders 53, 54, 56, 57 are driven.

In this case, each plate cylinder 48, 49, 51, 52 has its own drive motor 62, 63, 64, 66, which is independent of the rubber cylinders 53, 54, 56, 57.

Figure 5:
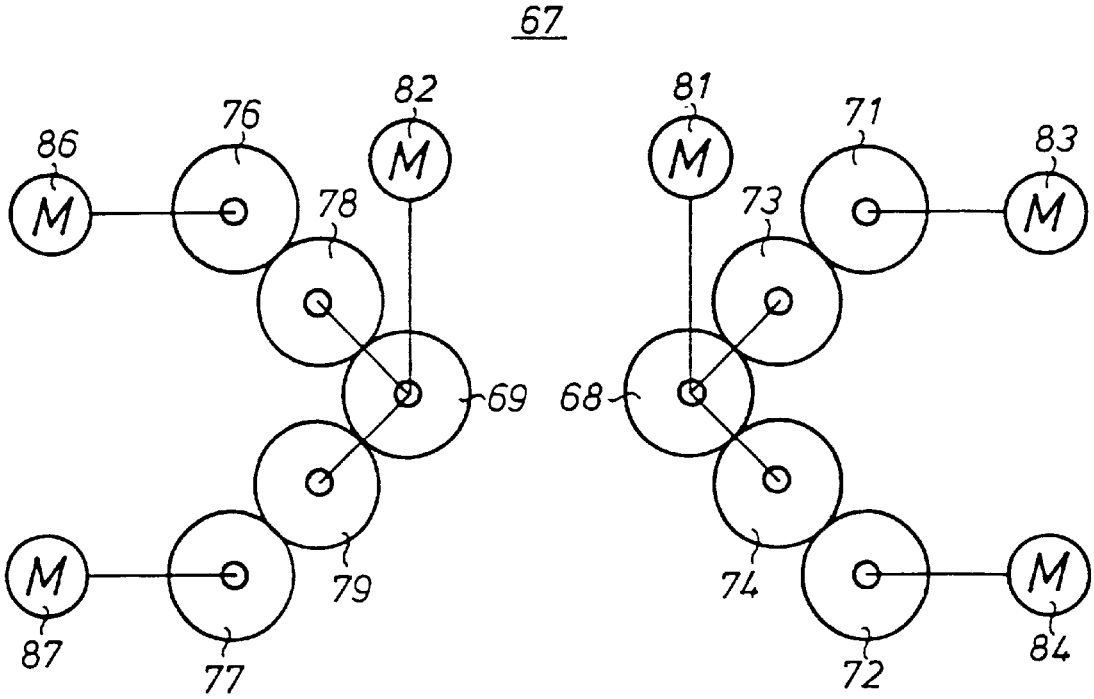

A print unit 67, which is designed as a so-called ten satellite unit is shown in a fourth preferred embodiment, as seen in FIG. 5.

This 10 satellite print unit 67 is constructed axially symmetrical with respect to a vertical line and has two satellite cylinders 68, 69 acting as counter-pressure cylinders 68, 69. Two plate and rubber blanket cylinders 71, 73; 72, 74, or respectively 76, 78; 77, 79, are assigned to these counter-pressure cylinders 68 or 69, respectively. In this case, two rubber blanket cylinders 73, 74, or respectively 78, 79, and the associated counter-pressure cylinder 68, or respectively 69, are coupled and are driven by a drive motor 81 or 82, respectively. Each one of the associated plate cylinders 71, 72, or respectively 76, 77, has its own drive motor 83, 84, or respectively 86, 87.

It is also possible to provide each one of the counter-pressure cylinders 68 or 69 with its own drive motor and not to couple it with the associated rubber blanket cylinders 73, 74, or respectively 78, 79. In this case, these two associated rubber blanket cylinders 73, 74, or respectively 78, 79, are coupled and have their own drive motor, which is independent of the plate cylinders 71, 72, or respectively 76, 77, as well as being independent of the counter-pressure cylinders 68, or respectively 69.

It is common to all of the above-described preferred embodiments that the plate cylinders 2, 3; 29, 31, 32, 33; 48, 49, 51, 52; 71, 72, 76, 77 have their own drive motor 26, 27; 42, 43, 44, 46; 62, 63, 64, 66; 83, 84; 86, 87, and that at least two rubber blanket cylinders 4, 6; 34, 36; 37, 38; 53, 54, 56, 57; 73, 74; 78, 79 are coupled in a print unit 1, 28, 47, 67 and have a common drive motor 24; 39, 41; 59; 61; 81; 82, which is independent of the plate cylinders 2, 3; 29, 31, 32, 33; 48, 49, 51, 52; 71, 72, 76, 77.

In place of gear wheels, it is also possible to provide other driving means, such as belts, for example, for the mechanical coupling of the rubber blanket cylinders 4, 6; 34, 36; 37, 38; 53, 54, 56, 57; 73, 74; 78, 79, or respectively the counter-pressure cylinders 58, 68, 69. The coupling of the rubber blanket cylinders 4, 6; 34, 36; 37, 38; 53, 54, 56, 57; 73, 74; 78, 79, or respectively the counter-pressure cylinders 58, 68, 69, for common driving is preferably accomplished by an interlocking drive connection by means of gear wheels or toothed belts.

Figure 6:
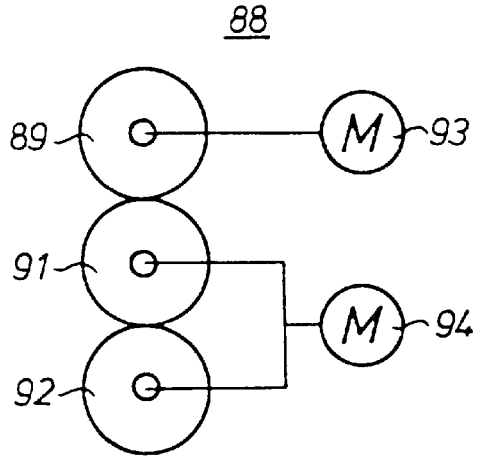

A print unit 88, consisting of a forme cylinder 89, a rubber blanket cylinder 91 and a counter-pressure cylinder 92 is depicted in a fifth preferred embodiment as seen in FIG. 6. The forme cylinder 89 is separately driven by means of a drive motor 93. The rubber blanket cylinder and the counter-pressure cylinder 92 are coupled for being driven and are driven by a common drive motor 94. The drive mechanism of the rubber blanket and the counter-pressure cylinders 91, 92 is independent of the driving mechanism of the forme cylinder 89.

Figure 7:
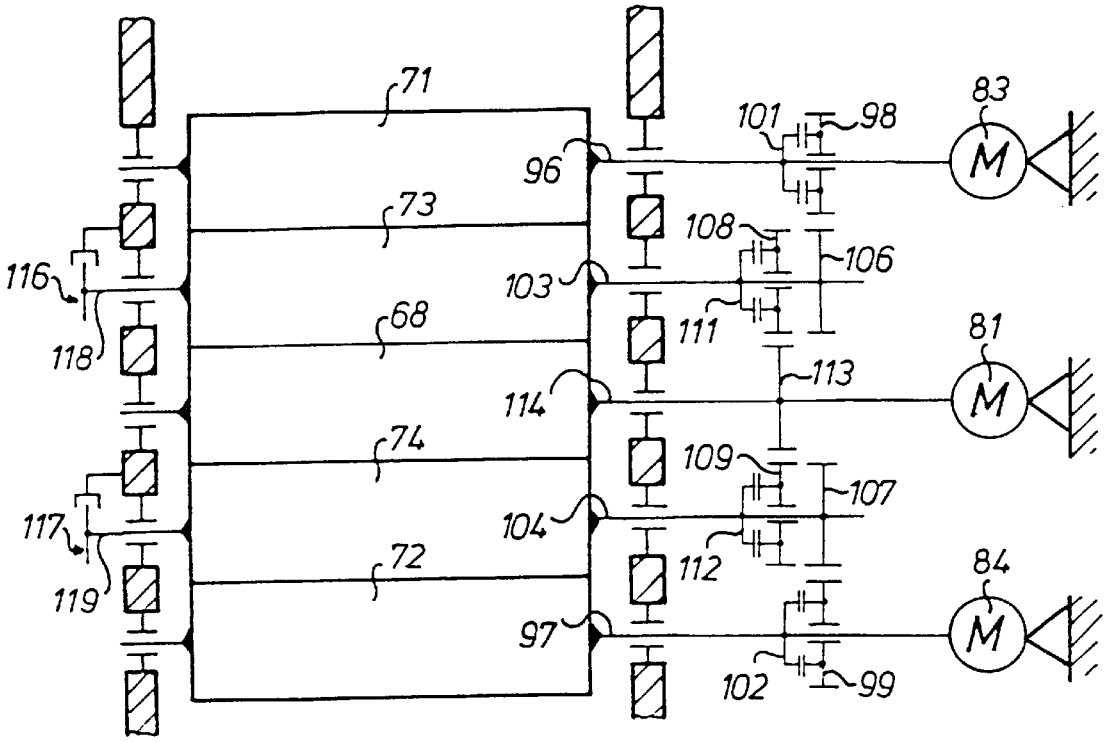

A variation of the fourth preferred embodiment is represented in the sixth preferred embodiment which is shown in FIG. 7. A gear wheel 98, 99 is rotatably seated on a journal 96, 97 of each of the forme cylinders 71, 72. This forme cylinder gear wheel 98, 99 can be selectively connected with the journal 96, 97 by means of a controllable coupling 101, 102, preferably a definite positive coupling. This forme cylinder gear wheel 98, 99 engages a blanket cylinder gear wheel 106, 107, which is connected, fixed against relative rotation, with the journal 103, 104 of the rubber blanket cylinder 73, 74. A second, rotatable, blanket cylinder gear wheel 108, 109 is rotatably seated on the journal 103, 104 of the rubber blanket cylinder 73, 74. This second, rotatable blanket cylinder gear wheel 108, 109 can be selectively brought into a connection, fixed against relative rotation, with the journal 103, 104 of the rubber blanket cylinder 73, 74 by means of a controllable coupling 111, 112. These second, rotatable gear wheels 108, 109 of the two rubber blanket cylinders 73, 74 mesh with a gear wheel 113 of the counter-pressure cylinder 68. This gear wheel 113 is connected, fixed against relative rotation, with a journal 114 of the counter-pressure cylinder 68. Brakes 116, 117 which, for example, are arranged on the second journals 118, 119 of the rubber blanket cylinders 73, 74, can work together with the two rubber blanket cylinders 73, 74.

In a first mode of operation, the couplings 111, 112 of the rubber blanket cylinders 73, 74 are closed, so that the second, rotatable gear wheels 108, 109 are connected, fixed against relative rotation, with the blanket cylinder journals 103, 104, and the rubber blanket cylinders 73, 74 are driven by the electric motor 81 of the counter-pressure cylinder 68. The couplings 101, 102 of the forme cylinders 71, 72 are open, so that the forme cylinder gear wheels 98, 99 can freely rotate on the journals 96, 97 of the forme cylinders 71, 72. The forme cylinders 71, 72 are driven by the electric motors 83, 84 associated with them. In a second mode of operation, the forme cylinder 71, for example, is stopped for a plate change. The associated rubber blanket cylinder 73 can also be stopped by releasing the coupling 111 and by setting the brake 116. In this "print off" position, the forme cylinder 71 can now be rotated by means of the electric motor 83 while the rubber blanket cylinder 73 is stopped.

In a third mode of operation, the forme cylinder 71 and the rubber blanket cylinder 73 are coupled with each other and, during "print-off", they can be rotated together by means of the electric motor 83, independently of the counter-pressure cylinder 68. To this end, the coupling 101 of the forme cylinder 71 is closed, and the coupling 111 of the associated rubber blanket cylinder 73 is open.

Driving of the cylinders is preferably accomplished by means of positionally adjustable electric motors, for example a.c. motors.

It is possible to arrange the rotor of the drive motor directly on the cylinder journal, or to connect the drive motor indirectly with the cylinder journal by means of a gear, for example gear wheels or belt drives.

During printing, driving of each of the forme cylinders is accomplished by their own drive motors independently of, i.e. not interconnectedly coupled with the associated transfer cylinder.

Driving of ink units associated with the forme cylinders 2, 3; 29, 31, 33, 32; 48, 49, 51, 52; 71, 72, 76, 77, 89 can take place by means of the drive motor 24; 39, 41; 59; 81; 82, 93 of the forme cylinder 2, 3; 29, 31, 32, 33; 48, 49, 51, 52; 71, 72, 76, 77, 89, for example via gear or belt drives, or by means of one, or respectively several, individual drive motors.

In all of the above-described preferred embodiments the print units are arranged in a web-fed rotary printing press and print on a web of material.

While preferred embodiments of a print unit for a web-fed rotary printing press in accordance with the present invention have been set forth fully and completely hereinabove, it will be apparent to one of skill in the art that various changes in, for example the size of the various cylinders, the supply of the web of material, and the like can be made without departing from the true spirit and scope of the present invention which is accordingly to be limited only the following claims.

What is claimed is:

1. A print unit of an offset printing press, said print unit comprising:

a first forme cylinder;

a first drive motor in said print unit for driving only said first forme cylinder;

a second forme cylinder;

a second drive motor in said print unit for driving only said second forme cylinder;

a first transfer cylinder associated with said first forme cylinder;

a second transfer cylinder associated with said second forme cylinder; and a third drive motor in said print unit, said third drive motor being coupled to said first and second transfer cylinders, said third drive motor in said print unit driving both of said first and second transfer cylinders located in said print unit.

2. The print unit of claim 1 further including a coupling for selectively drivingly coupling one of said first and second transfer cylinders to its associated one of said first and second forme cylinders.

3. The print unit of claim 1 wherein said offset printing press is a web-fed printing press.

4. The print unit of claim 1 further including a counter-pressure cylinder associated with both of said at least first and second transfer cylinders.

5. The print unit of claim 4 wherein said counter-pressure cylinder is coupled to said first and second transfer cylinders and is driven with both of said first and second transfer cylinder by said third motor.

6. The print unit of claim 4 further including a fourth drive motor in said print unit, said fourth drive motor driving said counter-pressure cylinder.

7. The print unit of claim 4 wherein said counter-pressure cylinder is associated with two of said at least first and second transfer cylinders.

8. The print unit of claim 4 further including third and fourth transfer cylinders and wherein said counter-pressure cylinder is associated with said first, second, third and fourth transfer cylinders.

9. The print unit of claim 7 wherein said print unit is a ten satellite print unit.

10. The print unit of claim 8 wherein said print unit is a nine satellite print unit.

11. A print unit for printing a print side of a web in an offset printing unit, said print unit comprising:

a forme cylinder;

a transfer cylinder engageable with said forme cylinder;

a counter-pressure cylinder engageable with a non-print side of said web, said transfer cylinder printing said print side of said web passing between said transfer cylinder and said counter-pressure cylinder;

a first drive motor in said print unit for driving said forme cylinder; and a second drive motor in said print unit for driving both said transfer cylinder and said counter-pressure cylinder.

* * * * *